United States Patent [19]

Nakamura

[11] Patent Number: 4,747,289

[45] Date of Patent: May 31, 1988

[54] METHOD OF FORMING SEAM-WELDED TUBES

[75] Inventor: Masayuki Nakamura, Yokohama, Japan

[73] Assignee: Ishikawajima-Harima Jukogyo Kabushiki Kaisha, Tokyo, Japan

[21] Appl. No.: 36,151

[22] Filed: Apr. 6, 1987

Related U.S. Application Data

[63] Continuation of Ser. No. 696,597, Jan. 31, 1985, abandoned.

[30] Foreign Application Priority Data

Feb. 7, 1984 [JP] Japan ..... 59-15535
Feb. 7, 1984 [JP] Japan ..... 59-20309

[51] Int. Cl.[4] ..... B21D 5/12; B23K 31/06

[52] U.S. Cl. ..... 72/178; 72/52; 72/181; 228/147

[58] Field of Search ..... 72/51, 52, 178, 181; 228/17, 17.5, 146, 147, 150, 151

[56] References Cited

U.S. PATENT DOCUMENTS

| | | | |
|---|---|---|---|
| 3,323,341 | 6/1967 | Chang | 72/178 |
| 3,472,053 | 10/1969 | Chang | 72/178 |
| 4,070,887 | 1/1978 | Hankin | 72/52 |
| 4,122,696 | 10/1978 | Midzutani et al. | 72/52 |
| 4,299,108 | 11/1981 | Kato et al. | 72/52 X |
| 4,339,938 | 7/1982 | Nakagawa et al. | 72/178 |
| 4,487,046 | 12/1984 | Abbey | 72/52 |

FOREIGN PATENT DOCUMENTS

| | | | |
|---|---|---|---|
| 950719 | 2/1964 | United Kingdom | 72/178 |
| 2027373 | 2/1980 | United Kingdom . | |
| 484914 | 9/1975 | U.S.S.R. | 72/52 |

*Primary Examiner*—E. Michael Combs

[57] ABSTRACT

The present invention is directed to a method and apparatus for forming seam welded tubes in which the positions of cage rolls are adjusted in accordance with the thickness, substance and size of a material to be formed into a tube in a process for forming a tube blank for a seam-welded tube by using cage rolls.

3 Claims, 7 Drawing Sheets

METHOD OF FORMING SEAM-WELDED TUBES

This application is a continuation of application Ser. No. 696,597, filed Jan. 31, 1985, now abandoned.

BACKGROUND OF THE INVENTION

This invention relates to a method and apparatus for forming seam-welded tubes by bending a strip cylindrically, and then pressing the resultant product in the circumferential direction thereof by fin pass rolls into a tube blank, and more particularly relates to a method and apparatus for forming seam-welded tubes which is suitably applied to a process for forming seam-welded tube blanks using cage rolls.

In general, a seam-welded tube based on a forming step using cage rolls is manufactured in the following manner. As shown in FIGS. 1 and 2, a strip material 1 is gradually formed into a cylindrical shape by a preforming roll unit 2, which is used in initial and intermediate forming stages, a breakdown roll unit 3, an edge forming roll unit 4 and a cage roll unit 5. This cylindrically-formed product is then subjected to a finishing step, in which it is pressed in its circumferential direction by a fin pass roll unit 6, to form an edge portion 1a thereof stably and thereby obtain a tube blank of a predetermined size. FIGS. 2A through 2G show the strip material 1 varying gradually into a cylindrical form, wherein FIG. 2A shows a cross-sectional shape of the material 1 passing through the preforming roll unit 2; FIG. 2B, a cross-sectional shape of the material 1 passing the breakdown roll unit 3; FIG. 2C, a cross-sectional shape of the material 1 passing through the edge forming roll unit 4; FIGS. 2D–2F, the cross-sectional shapes of the material 1 passing through the cage roll unit 5; and FIG. 2G, a cross-sectional shape of the material 1 passing through the fin pass roll unit 6.

In the above-mentioned forming step using cage rolls, the so-called downhill grade forming is usually done, in which the central portion 1*b* of the strip material 1 is lowered to a base line L as the forming progresses, as shown in FIGS. 3–5. In this forming step, a smooth bend-forming operation is carried out in which a difference between the lengths of loci along which the edge portion 1*a* and the central portion 1*b* of the strip material 1 are moved is minimized to suppress lengthwise extension of the edge portion 1*a*, and the edge portion 1*a* is supported continuously in a restricted state by a plurality of successively-arranged outside cage rolls 7 (See FIGS. 2D–2F).

In the above seam-welded tube-forming apparatus, it is necessary to adjust the positions of the outside cage rolls 7 in accordance with the size of a tube to be formed. In order to meet the requirement, an apparatus constructed as shown in FIG. 6 was developed. This apparatus comprises a common base 8 set firmly on the groundwork, stools 9 on the common base 8 each having a surface 9*a* of a predetermined angle of inclination, said stools 9 being disposed in an opposed relationship so as to sandwich a line along which the strip material 1 passes, guide mechanisms 10 on the inclined surfaces 9*a* of the stools 9, displacement mechanisms 12 adapted to be moved by driving means 11 along the guide mechanisms 10 in the directions parallel to the inclined surfaces 9*a* of the stools 9, and cage rolls 7 attached to the displacement mechanisms 12 via angle-adjusting means 13.

According to this seam-welded tube-forming apparatus, when the displacement mechanisms 12 are moved along the guide mechanisms 10 by actuation of the driving means 11 as shown in FIGS. 7 and 8, the cage rolls 7 can be displaced linearly along the inclined lines 10*a* and 10*b*, so that the cage rolls 7 can be brought into contact with the strip material 1 in the positions corresponding to the size thereof.

However, this advantage can be obtained only when the downhill quantity is constant (usually 1D, wherein D is the diameter of a tube to be formed) as shown in FIG. 3. When the downhill quantity is varied between 0 and 1D (See two-dot chain lines in FIG. 3), the above apparatus cannot be used. Namely, when the downhill quantity and a flower-shaped forming pattern (loci of the edge portions 1*a* in FIG. 5) are determined, the mechanical system as a whole is determined so that the angles of the inclined lines 10*a* and 10*b* are also determined. Therefore, when the downhill quantity is varied between 0 and 1D, in accordance with the thickness, substance, grade and size of the strip material 1, the conventional apparatus described above cannot be used practically.

Preferred embodiments of the present invention will now be described with reference to the drawings.

DETAILED DESCRIPTION OF PREFERRED EMBODIMENTS

Figure 1:
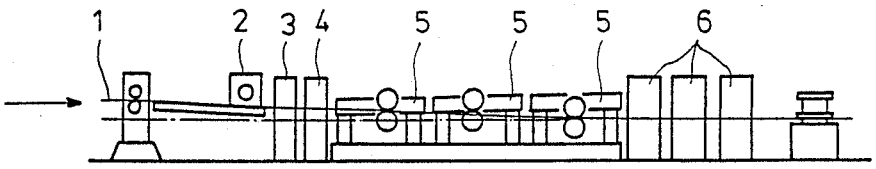
FIG. 1 is a diagram showing a tube blank-forming process in a cage roll type seam-welded tube-forming apparatus.
Figure 2A:
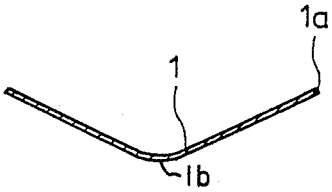
FIGS. 2A–2G show the cross-sectional shapes of a strip material in the tube blank-forming process.
Figure 2B:
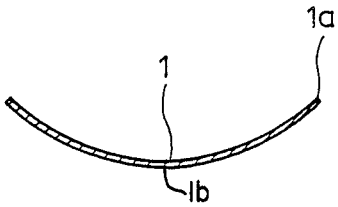
Figure 2C:
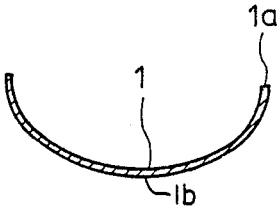
Figure 2D:
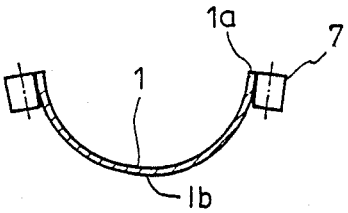
Figure 2E:
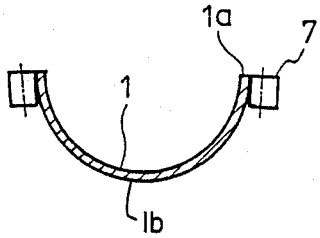
Figure 2F:
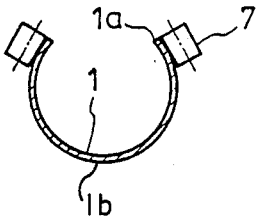
Figure 2G:
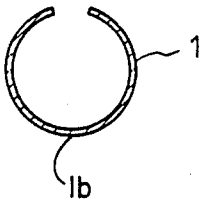
Figure 3:
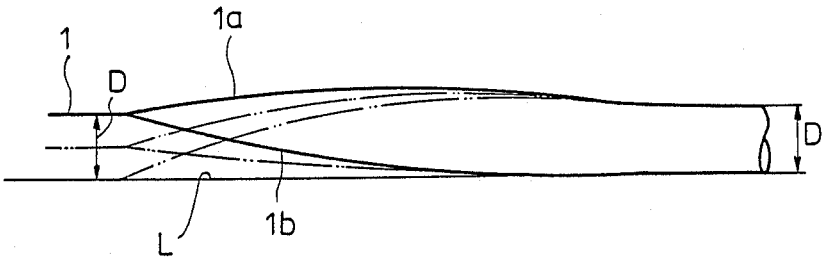
FIG. 3 is a schematic diagram showing the condition of a strip material being subjected to a downhill forming operation.
Figure 4:
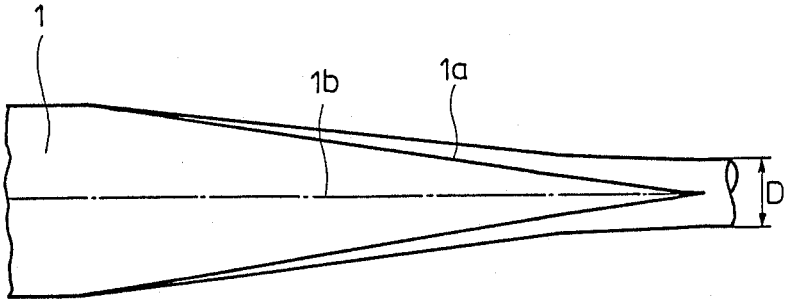
FIG. 4 is a plan view of FIG. 3.
Figure 5:
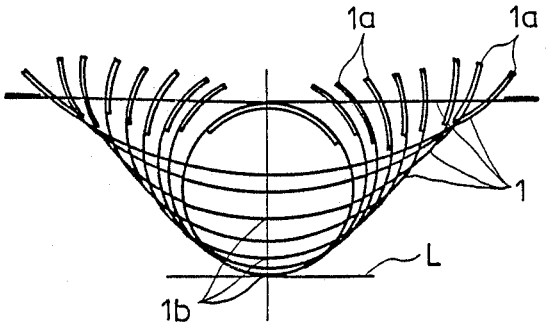
FIG. 5 is a front elevation of FIG. 4.
Figure 6:
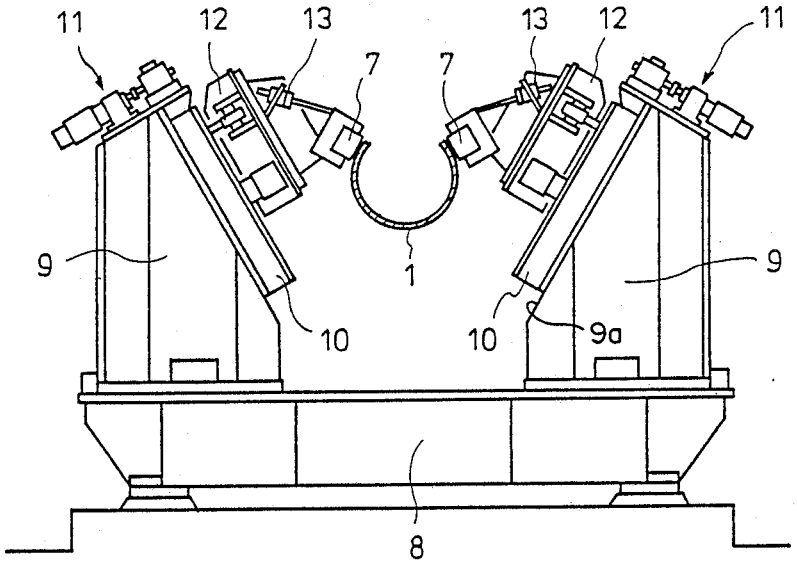
Fig.6 PRIOR ART
FIG. 6 is a schematic front elevation of a conventional seam-welded tube-forming apparatus.
Figure 7:
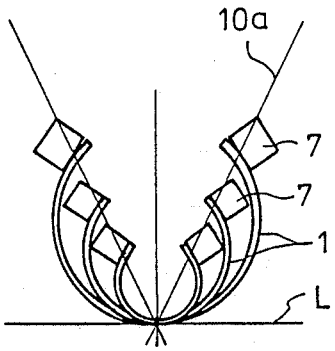
Fig.7 PRIOR ART
FIGS. 7 and 8 show the positions of cage rolls with respect to strip materials of different sizes in the apparatus shown in FIG. 6.
Figure 8:
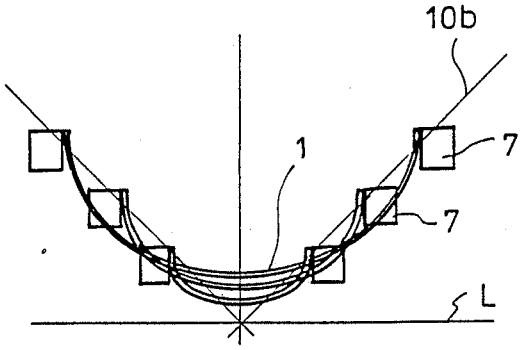
Fig.8 PRIOR ART
Figure 9:
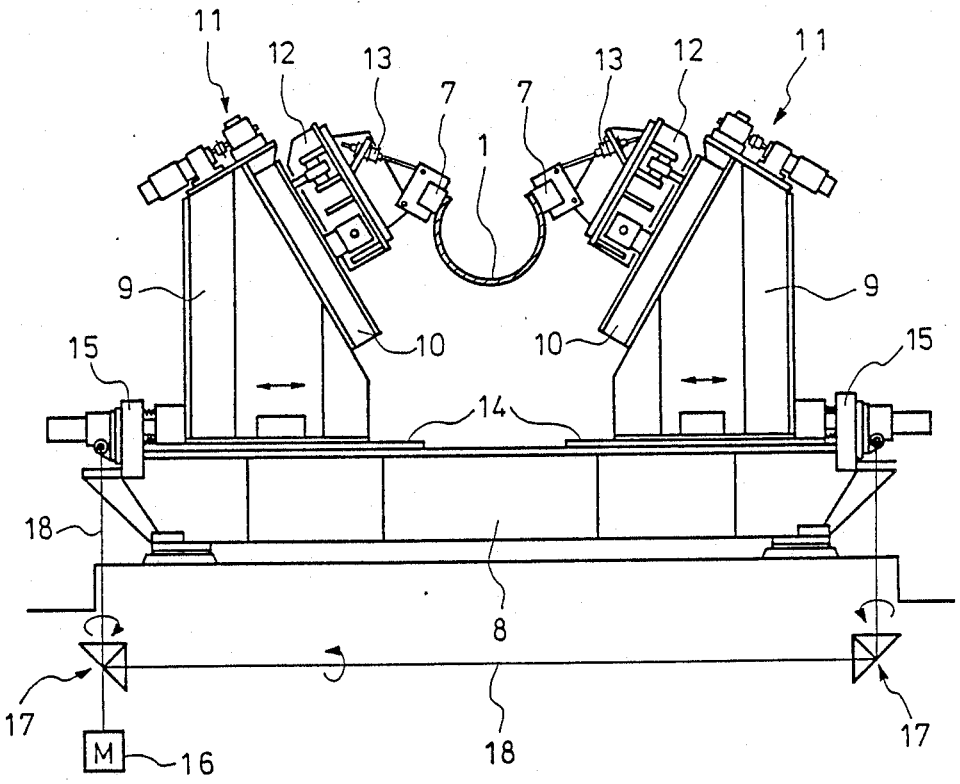
FIG. 9 is a schematic front elevation of a first embodiment of the seam-welded tube-forming apparatus according to the present invention.

FIG. 9 shows a first embodiment of the seam-welded tube-forming apparatus according to the present invention. In this apparatus, guide members 14 are fixed to the left and right portions of a common base 8, which is identical with the common base in the seam-welded tube-forming apparatus of FIG. 6, in such a manner that the guide members 14 extend at right angles to a line along which a strip material 1 passes. Stools 9 are slidably engaged with the guide members 14, and worm jacks 15 are secured to the left and right ends of the common base 8 so that the worm jacks 15 are opposed to each other. When the worm jacks 15 are driven synchronously by a motor 16 via bevel gears 17 and transmission shafts 18, the stools 9 can be moved toward and away from each other so that the positions of the cage rolls 7 can be adjusted in the direction which is at right angles to the line along which the strip material 1 passes.

Figure 10:
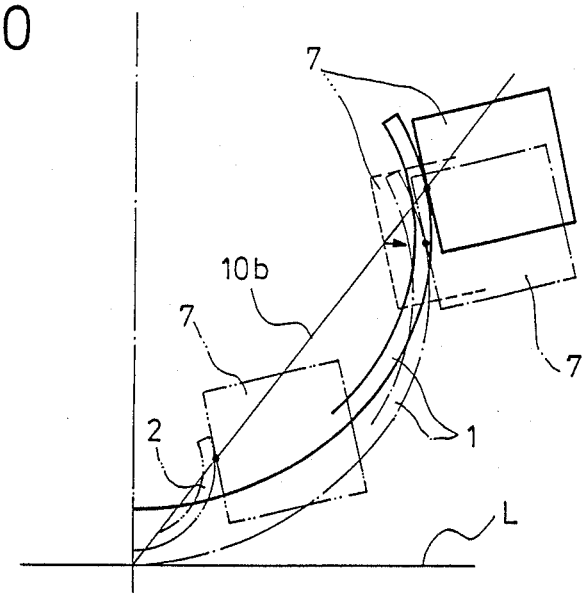
FIGS. 10 and 11 illustrate a cage roll-adjusting mode in the apparatus shown in FIG. 9.

The operation of the first embodiment will now be described. In order to displace the cage rolls 7 from a position shown by a full line in FIG. 10 in which a strip material 1 to be formed into a large-diameter tube is pressed, to a position shown by a two-dot chain line in the same drawing in which a strip material 1 to be formed into a small-diameter tube is pressed with the downhill quantity being 1D, the cage roll 7 is driven in the same manner as the cage roll in the above-mentioned conventinal apparatus, i.e. form the first-mentioned position shown in the full line to the second-mentioned position shown in two-dot chain line along a set inclined line **10*b* by a driving means 11 via the movement of a displacement mechanism 12**.

In order to adjust the position of the cage roll 7 in accordance with a strip material 1, which has a downhill quantity varying as shown by a one-dot chain line and which is to be formed into a large-diameter tube, the cage roll 7 is temporarily transferred by the driving means 11 from the position of a full line to the position of a broken line along the inclined line **10*b*, and then the worm jack 15 is actuated by the motor 16 so as to move the stool 9 back along the guide member 14 in the direction which is at right angles to the line along which the material 1 passes. Consequently, the cage roll 7 is moved from the position of the broken line to the position of the one-dot chain line to complete the operation for adjusting the position of the cage roll 7**. This cage roll-displacing operation may also be carried out in the opposite direction; the cage roll may be displaced forward or backward so as to finally set it in the position of the one-dot chain line.

The diameter and length of the cage roll 7 are generally determined by taking the strength thereof into consideration. The cage roll 7 is applied to both a large-diameter tube being formed and a small-diameter tube being formed. Accordingly, when the cage rolls 7 are applied to a small-diameter tube being formed, the end portions thereof will interfere with each other as shown by two-dot chain lines in FIG. 11. Namely, the forming capability of the cage rolls in a conventional seam-welded tube-forming apparatus is limited with respect to tube size.

Figure 11:
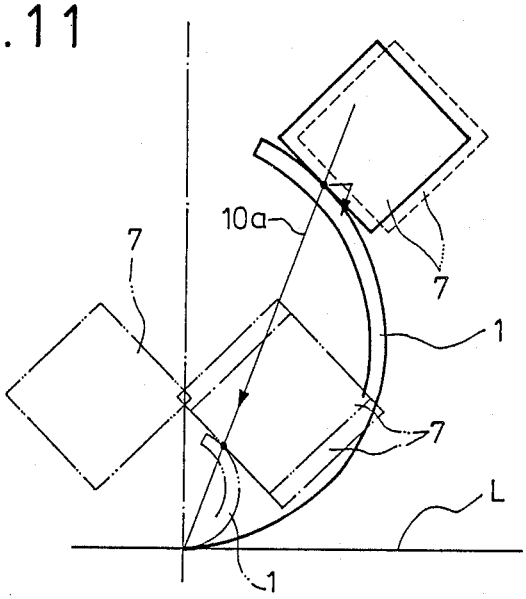

However, according to the present invention, the cage roll 7 in the position of a full line (on the set inclined line **10*a*) in FIG. 11 is once shifted in the above-mentioned case to the position of a broken line via the movement of the stool 9 made by an operation of the worm jack 15. The cage roll 7 is then moved to the position of the one-dot chain line via the displacement mechanism 12. This can prevent interference such as mentioned above of the cage rolls 7** with each other. Accordingly, the tube-forming capability of the cage can be improved.

A cylinder system or a rack-pinion system may be employed as means for moving the stools 9 toward and away from each other.

Figure 12:
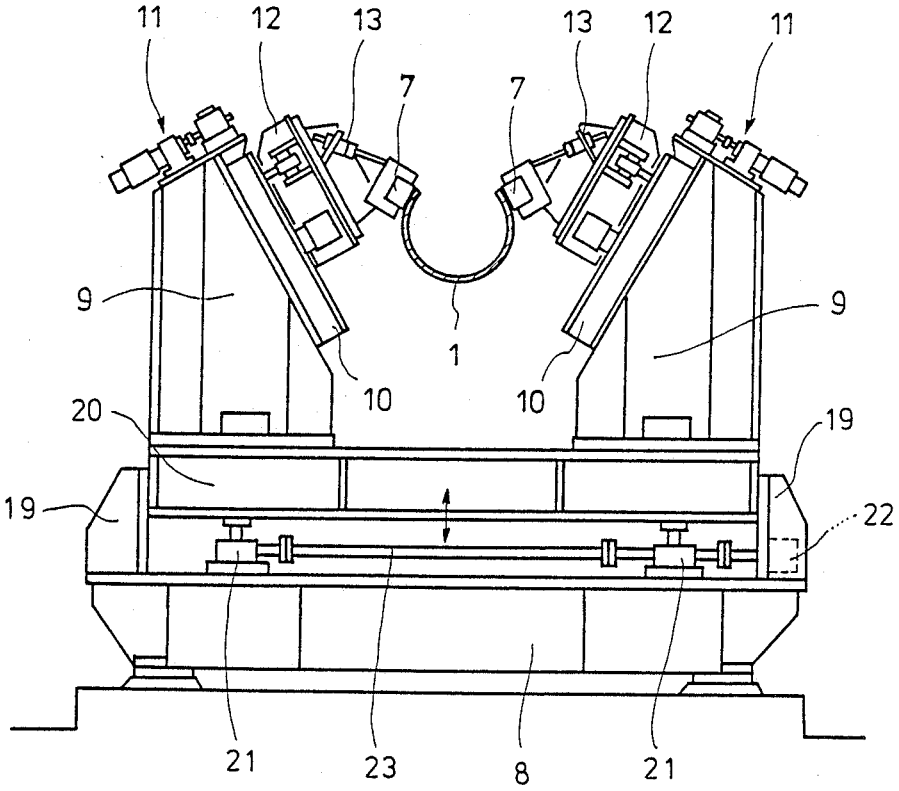
FIG. 12 is a schematic front elevation of a second embodiment of the seam-welded tube-forming apparatus according to the present invention.

FIG. 12 shows a second embodiment of the seam-welded tube-forming apparatus according to the present invention. In this apparatus, a support beam 20 is provided on a common base 8 so that the beam 20 can be moved up and down along lift guides 19 which are fixed to the left and right end portions of the common base 8. Stools 9 are set on the support beam 20, and electric jacks 21 are provided between the support beam 20 and the common base 8 in such a manner that the jacks 21 can be extended and contracted synchronously by a motor 22 via a transmission shaft 23.

The reference numerals in FIG. 12 which are identical with those in FIG. 9 denote the same parts.

Figure 13:
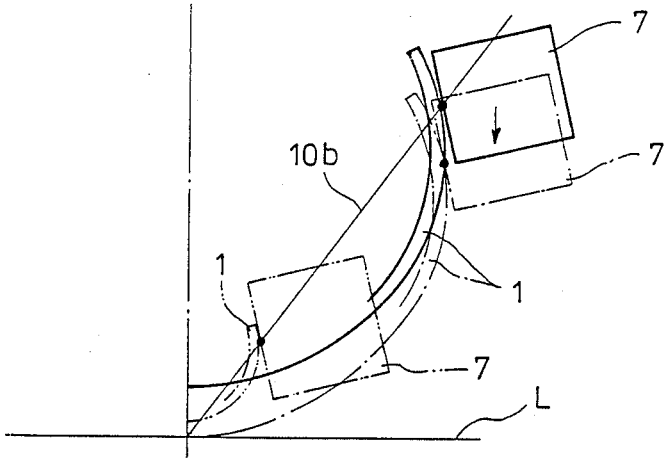
FIGS. 13 and 14 illustrate a cage roll-adjusting mode in the apparatus shown in FIG. 12.

Referring now to FIG. 13, in order to displace a cage roll 7 from a position shown by the solid line in which a strip material 1 being formed into a large-diameter tube is pressed, to a position shown by the two-dot chain line in which a strip material 1 being formed into a small-diameter tube and having a downhill quality of 1D is pressed, the same steps as in a conventional apparatus are taken. Namely, a driving means 11 is operated to move via the displacement mechanism 12 the cage roll 7 from the position of a full line to the position of a two-dot chain line along a set inclined line **10*b***.

On the other hand, in order to adjust the position of the cage roll 7 in accordance with the strip material 1 being fomed into a large-diameter tube and having a downhill quantity varied as shown by the one-dot chain line, the motor 22 is driven to operate the jacks 21 and lower the stool 9 via the support beam 20. The cage roll 7 is thus lowered to the position of the one-dot chain line to engage the same with the material 1. When the downhill quantity of the strip material 1 is varied into a position which is halfway between a large diameter tube-forming position and a small diameter tube-forming position, the cage roll 7 can be displaced to a suitable extent in the vertical and slant directions by extending and contracting the jacks 21 and operating the displacement mechanism 12.

Figure 14:
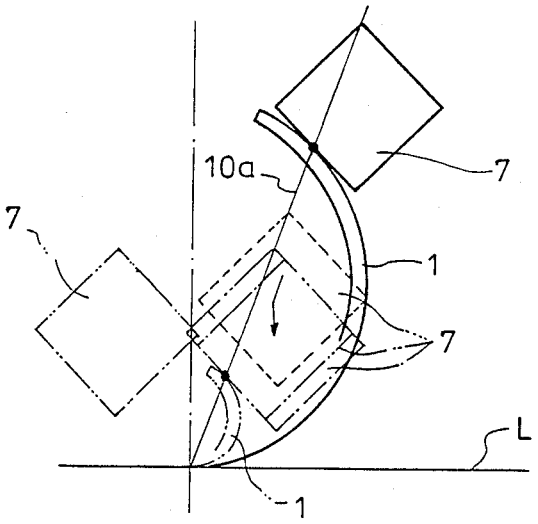

When the end portions of the cage rolls 7, which are in engagement with a strip material being formed into a small-diameter tube, in the second embodiment interfere with each other as shown by the two-dot chain lines in FIG. 14, the cage roll 7 in the position of the solid line in FIG. 14 is moved to a position in which the cage roll 7 does not interfere with the opposed cage roll 7, for example, the position shown by the broken line, along a set inclined line **10*a*. The cage roll 7 is then moved down to the position shown by the one-dot chain line. Consequently, the interference of the cage rolls 7** with each other can be prevented, and the tube-forming capability thereof can be improved.

The left and right stools 9 may be moved up and down independently of each other, and a rack-and-pinion system or a cylinder system may also be employed as lift means instead of the jack-operating system.

According to the present invention described above, the position of a cage roll can be adjusted in accordance with variations in the downhill quantity of a strip material being formed into a tube. Therefore, the capability of the apparatus can be improved, and the apparatus contributes much to the improvement in the productivity of seam-welded tubes. Also, automation and remote control of this apparatus can be done easily. The present invention has such excellent effects.

What is claimed is:

1. A method of forming seam-welded tubes of a diameter D from strip material, comprising the steps of positioning a plurality of sets of cage rolls along a line along which the strip material passes, with one roll of each set to one side of said line; applying the cage rolls to the strip material to form the tube so as to lower a central portion of the strip material to a base line by an amount defined as a downhill quantity; and of:

varying the downhill quantity as forming of the tube progresses, depending on thickness, substance, grade and size of the strip material between a value greater than zero 0 and up to 1D by displacing the cage rolls at right angles with respect to the line along which the material passes, and by displacing the cage rolls along a line which is inclined with respect to the line along which the material passes.

2. The method defined in claim 1, wherein the step of displacing the cage rolls at right angles with respect to the line along which the material passes includes displacing the cage rolls vertically.

3. The method defined in claim 1, wherein the step of displacing the cage rolls at right angles with respect to the line along which the material passes includes displacing the cage rolls horizontally.

* * * * *